United States Patent [19]

Bishop et al.

[11] 4,389,479

[45] Jun. 21, 1983

[54] NEUTRALIZING LAYER FOR COLOR TRANSFER ASSEMBLAGES

[75] Inventors: John F. Bishop, Rochester; Wayne A. Bowman, Walworth, both of N.Y.

[73] Assignee: Eastman Kodak Company, Rochester, N.Y.

[21] Appl. No.: 263,523

[22] Filed: May 14, 1981

[51] Int. Cl.[3] ..... G03C 1/40; G03C 5/54; G03C 1/78; G03C 1/76

[52] U.S. Cl. ..... 430/216; 430/237; 430/454; 430/463; 430/505; 430/536; 428/520; 428/522

[58] Field of Search ..... 430/216, 215, 237, 454, 430/463, 536, 505; 428/520, 522

[56] References Cited

U.S. PATENT DOCUMENTS 3,765,885 10/1973 Bedell ..... 430/216
4,138,260 2/1979 Krafft et al. ..... 430/216
4,190,448 2/1980 Sera et al. ..... 430/216
4,256,827 3/1981 Noguchi et al. ..... 430/215
4,296,195 10/1981 Bishop et al. ..... 430/215

FOREIGN PATENT DOCUMENTS 2006451A 5/1979 United Kingdom .
2021796A 12/1979 United Kingdom .

OTHER PUBLICATIONS

Research Disclosure, vol. 135, Jul. 1975, Item 13525.

*Primary Examiner*—Richard L. Schilling
*Attorney, Agent, or Firm*—Harold E. Cole

[57] ABSTRACT

Photographic assemblages, elements, receiving elements and cover sheets are described employing a novel neutralizing layer comprising a cross-linked polymer having recurring units of an N-(alkoxy-methyl)acrylamide, an acrylic acid and an alkyl acrylic ester. The need for a separate cross-linking agent is eliminated.

55 Claims, No Drawings

NEUTRALIZING LAYER FOR COLOR TRANSFER ASSEMBLAGES

This invention relates to photography, and more particularly to photographic assemblages, elements, receiving elements and cover sheets for color diffusion transfer photography wherein a novel neutralizing layer is employed. This neutralizing layer comprises a cross-linked polymer having recurring units of an N-(alkoxymethyl)acrylamide, an acrylic acid and an alkyl acrylic ester.

Various formats for color, integral transfer elements are described in the prior art, such as U.S. Pat. Nos. 3,415,644; 3,415,645; 3,415,646; 3,647,437; 3,635,707; 3,756,815, and Canadian Pat. Nos. 928,559 and 674,082. In these formats, the image-receiving layer containing the photographic image for viewing remains permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject.

Other so-called "peel apart" formats for color diffusion transfer assemblages are described, for example, in U.S. Pat. Nos. 2,983,606; 3,362,819 and 3,362,821. In these formats, the image-receiving element is separated from the photosensitive element after development and transfer of the dyes to the image-receiving layer.

In color transfer assemblages such as those described above, a "shut down" mechanism is needed to stop development after a predetermined time, such as 20 to 60 seconds in some formats, or up to 3 minutes or more in other formats. Since development occurs at a high pH, it is stopped by merely lowering the pH. The use of a neutralizing layer, such as a polymeric acid, can be employed for this purpose, which will stabilize the element after the required diffusion of dyes has taken place. A timing layer is usually employed in conjunction with the neutralizing layer, so that the pH is not prematurely lowered, which would stop or restrict development. The development time is thus established by the time it takes the alkaline composition to penetrate through the timing layer. As the system starts to become stabilized, alkali is depleted throughout the structure, causing silver halide development to cease or slow down in response to this drop in pH. For each image generating unit, this shutoff mechanism establishes the amount of silver halide development and the related amount of dye formed according to the respective exposure values.

In general, it has been found that neutralizing layers should be hardened, i.e., cross-linked. For example, *Research Disclosure,* Vol. 135, July 1975, Item 13525 discloses that a neutralizing layer of poly(acrylic acid) must be hardened by cross-linking. U.S. Pat. Nos. 4,138,260 and 4,190,448 also relate to neutralizing layers which are cross-linked.

In some photographic systems, the use of copolymers of acrylic acid and alkyl acrylic esters may avoid the necessity of using a hardener. However, in certain photographic systems, such as a two-sheet image transfer format, a hardener is generally employed in the polymeric acid neutralizing layer since there are more stringent adhesive requirements in that format. In a two-sheet image transfer process, a photosensitive or donor element is employed along with a dye image-receiving element. The receiving element usually comprises a support having thereon a dye image-receiving layer. The donor element usually consists of a support having thereon photosensitive silver halide emulsion layers having associated therewith dye image-providing materials. The donor element may also have process control layers for terminating development after the required development has taken place. Such layers usually include one or more timing layers and a neutralizing layer.

In practice, the donor element is exposed, soaked in a highly alkaline processing composition for 10 seconds or more at elevated temperatures ranging up to 32° C., and then laminated to the receiving element. An imagewise distribution of dye image-providing material from the donor diffuses to the receiving element. After a required period of time, the two elements are separated.

A common cross-linking agent for acrylic acid polymers and copolymers is a bis-epoxide hardener such as Araldite RD-2 (Trademark, Ciba-Geigy) which is believed to be 1,4-butanediol diglycidyl ether. When such hardeners are employed, however, unreactive epoxide or other fragments of the hardener can migrate out of the neutralizing layer and can change the properties of the timing layer, as will be shown hereinafter.

U.S. Pat. No. 3,765,885 relates to neutralizing layers comprising graft copolymers which include alkyl acrylate esters, acrylic acid and certain acrylamide groups. U.K. Patent application 2,006,451A relates to neutralizing layers which comprise vinyl monomers, such as acrylic acid, which may be copolymerized with other monomers including acrylamide. *Research Disclosure,* Vol. 174, October 1978, Item 17418 also discloses neutralizing layer copolymers which include an acrylamide moiety. The particular acrylamide moiety in the polymers employed in this invention is not described in these references, however, nor are these polymers disclosed as being self-hardenable.

U.K. patent application No. 2,021,796A relates to a timing layer for a color diffusion transfer process. This timing layer comprises a terpolymer of monomers from Groups A, B and C as described therein. Several of those monomers are the same or similar to those described herein. However, the weight percentages of the monomers are vastly different from the weight percentages of the various monomers described herein. There is no teaching in this U.K. patent application to change the weight percentages of the monomers described therein to the weight percentages of the monomers employed in this invention. To do so would change the function of such a layer so that it would no longer function as a useful timing layer.

It would be desirable to employ a neutralizing layer which has good swell characteristics, adhesive properties, physical integrity, and stability, and which does not require a separate cross-linking agent, yet can be internally cross-linked or hardened.

In accordance with our invention, a photographic assemblage is provided which comprises:

(a) a photographic element comprising a support having thereon at least one photosensitive silver halide emulsion layer having associated therewith a dye image-providing material;

(b) a dye image-receiving layer;

(c) a neutralizing layer for neutralizing an alkaline processing composition; and (d) a timing layer located between the neutralizing layer and the dye image-receiving layer so that the processing composition must first permeate the timing layer before contacting the neutralizing layer; and wherein the neutralizing layer comprises a cross-linked polymer derived from:

(i) 5 to 30 weight percent of recurring units which conform to the structure:

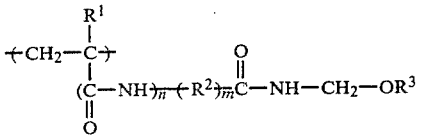

wherein $R^1$ is hydrogen or methyl;

$R^2$ is alkylene (straight or branched) having from 1 to about 10 carbon atoms such as methylene, ethylene, propylene, trimethylene or tetramethylene; arylenealkylene having from 7 to about 15 carbon atoms such as phenylenemethylene, phenyleneethylene, or phenylenetrimethylene; alkylenebisarylene having from 13 to about 20 carbon atoms such as methylenediphenylene or isopropylidenediphenylene; arylenebisalkylene having from 8 to about 15 carbon atoms such as phenylenedimethylene or phenylenediethylene; or arylene (substituted or unsubstituted) having from 6 to about 16 carbon atoms such as phenylene, naphthylene, or biphenylylene;

$R^3$ is an alkyl (including substituted alkyl) group of 1 to about 10 carbon atoms such as methyl, ethyl, propyl, isopropyl, isobutyl, octyl, 2-ethylhexyl, isononyl, or decyl; and n and m are 0 or 1 with the proviso that when m is 0, then n is 0, and when m is 1, then n is 0 or 1;

(ii) 30 to 80 weight percent of recurring units derived from a substituted or unsubstituted acrylic acid; and (iii) 5 to 30 weight percent of recurring units derived from an alkyl acrylic ester wherein the alkyl group has from 1 to about 16 carbon atoms.

In a preferred embodiment of our invention, n and m are each 0. In another preferred embodiment of our invention, $R^1$ is hydrogen and $R^3$ is an isobutyl group. Examples of N-(alkoxymethyl)acrylamide monomers useful in our invention include the following:

N-(isobutoxymethyl)acrylamide
N-(methoxymethyl)acrylamide
N-(methoxymethyl)methacrylamide
N-(ethoxymethyl)acrylamide
N-(isopropoxymethyl)acrylamide
N-(s-butoxymethyl)methacrylamide
N-(isohexoxymethyl)acrylamide
p-[N-(t-butoxymethyl)carbamoyl]styrene
N-[2-(N-isobutoxymethylcarbamoyl)ethyl]-acrylamide
N-[3-(N-isobutoxymethylcarbamoyl)-propyl]acrylamide
N-[4-(N-isobutoxymethylcarbamoyl)-butyl]methacrylamide
N-[2-(N-isopropoxymethylcarbamoyl)-ethyl]acrylamide
N-[3-(N-isopropoxymethylcarbamoyl)-propyl]acrylamide
N-[4-(N-isopropoxymethylcarbamoyl)-butyl]methacrylamide
N-[4-(N-isobutoxymethylcarbamoyl)-phenyl]acrylamide
N-[4-(N-isobutoxymethylcarbamoyl)-phenyl]methacrylamide Substituted acrylic acid monomers which can be employed in our neutralizing layers include the following:

acrylic acid
citraconic acid
α-chloroacrylic acid
methacrylic acid
fumaric acid
monoethyl fumarate
monomethyl fumarate
monomethyl itaconate
itaconic acid
maleic acid
mesaconic acid
α-methyleneglutaric acid
crotonic acid
monodecyl itaconate
monododecyl itaconate In a preferred embodiment of our invention, the acid moiety of the polymer is either acrylic acid or methacrylic acid.

Suitable alkyl acrylic esters having from 1 to about 16 carbon atoms which may be employed in the polymer described above include the following:

t-pentyl acrylate
n-pentyl acrylate
l-ethylpropyl acrylate
n-butyl acrylate
benzyl acrylate
t-butyl methacrylate
t-butyl acrylate
4-chlorobutyl acrylate
cyclohexyl acrylate
cyclopentyl acrylate
cetyl acrylate
cyclohexyl methacrylate
2-chloroethyl methacrylate
2-chloroethyl acrylate
ethyl methacrylate
isobutyl acrylate
2-ethylhexyl acrylate
n-hexyl methacrylate
2-ethyl-1-methylbutyl acrylate
2-ethylhexyl methacrylate
n-butyl methacrylate
isobutyl methacrylate
isopropyl methacarylate
lauryl acrylate
lauryl methacrylate
methyl acrylate
methyl α-chloroacrylate
methyl methacrylate n-octyl acrylate
n-octyl methacrylate
ethyl acrylate propyl acrylate
3-chloropropyl acrylate
n-hexyl acrylate
2,2-dimethylbutyl acrylate
neohexyl acrylate In a preferred embodiment, the alkyl acrylic ester moiety of the above polymer comprises an alkyl acrylate or methacrylate wherein the alkyl group has from 1 to about 6 carbon atoms. Butyl acrylate is especially preferred.

As described above, the neutalizing layer of our invention is a cross-linked polymer. Cross-linking can occur by either an acid-catalyzed mechanism or a thermal mechanism. According to American Cyanimid Company Process Chem. Dept. Bulletin PRC 126, dated February 1976, entitled "IMBA Monomer N-(isobutoxymethyl)acrylamide," these cross-linking mechanisms for the N-alkoxymethyl acrylamide monomer are believed to occur in the following manner:

Acid-Catalyzed Cross-Linking Mechanism

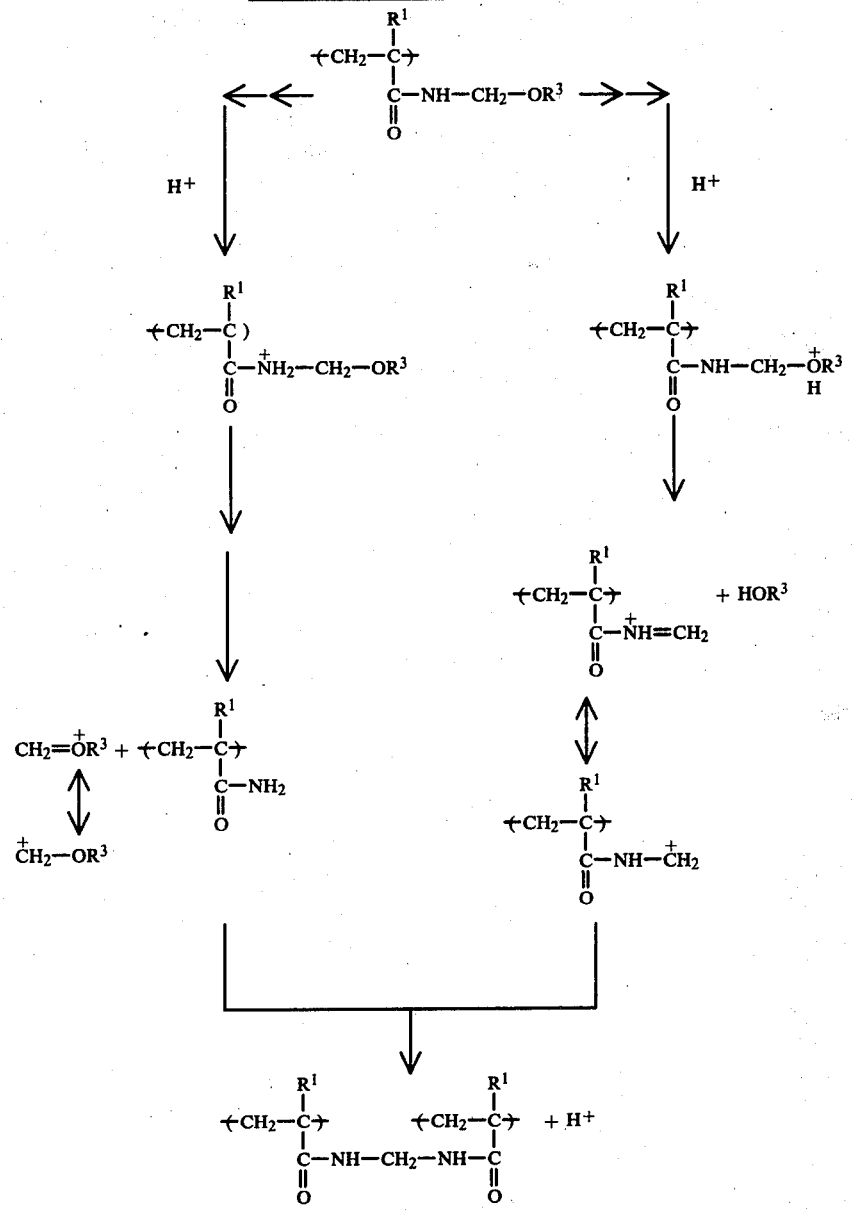

In the acid-catalyzed mechanism, any "strong" acid may be employed in any amount which is effective for the intended purpose. There can be employed, for example, p-toluenesulfonic acid, phosphoric acid, sulfuric acid, and virtually any alkyl or aromatic acid such as poly(vinylsulfonic acid) and poly(2-acrylamido-2-methylpropanesulfonic acid). Good results have been obtained when the acid catalyst is used at 1.5 percent of the weight of the polymer.

Thermal Cross-Linking Mechanism

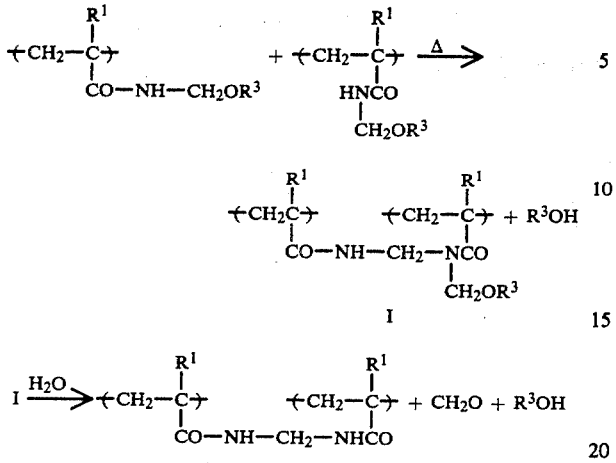

In the first step, thermal condensation yields structure I and an alcohol as the only cleavage product. This intermediate can be then hydrolyzed to give the cross-linked structure shown.

Thus, it is seen that the N-(alkoxymethyl) acrylamide monomer internally cross-links or self-hardens in the presence of heat or an acid as a catalyst. This eliminates the need for a separate cross-linking agent.

The polymeric neutralizing layer can be coated at any amount which is effective for the intended purpose. Preferably, it is coated at a coverage in the range of 40 to 100 milliequivalents acid/$m^2$, depending upon the alkali content of the activator which is to be neutralized.

The dye image-providing material useful in our invention is either positive- or negative-working, and is either initially mobile or immobile in the photographic element during processing with an alkaline composition. Examples of initially mobile, positive-working dye image-providing materials useful in our invention are described in U.S. Pat. Nos. 2,983,606; 3,536,739; 3,705,184; 3,482,972; 2,756,142; 3,880,658 and 3,854,985. Examples of negative-working dye image-providing materials useful in our invention include conventional couplers which react with oxidized aromatic primary amino color developing agents to produce or release a dye such as those described, for example, in U.S. Pat. No. 3,227,550 and Canadian Pat. No. 602,607. In a preferred embodiment of our invention, the dye image-providing material is a ballasted, redox-dye-releasing (RDR) compound. Such compounds are well known to those skilled in the art and are, generally speaking, compounds which will react with oxidized or unoxidized developing agent or electron transfer agent to release a dye. Such nondiffusible RDR's include positive-working compounds, as described in U.S. Pat. Nos. 3,980,479; 4,139,379; 4,139,389; 4,199,354, 4,232,107, 4,199,355 and German Pat. Nos. 2,854,946. Such nondiffusible RDR's also include negative-working compounds, as described in U.S. Pat. Nos. 3,728,113 of Becker et al; 3,725,062 of Anderson and Lum; 3,698,897 of Gompf and Lum; 3,628,952 of Puschel et al; 3,443,939 and 3,443,940 of Bloom et al; 4,053,312 of Fleckenstein; 4,076,529 of Fleckenstein et al; 4,055,428 of Koyama et al; 4,149,892 of Deguchi et al; 4,198,235 and 4,179,291 of Vetter et al; *Research Disclosure* 15157, November, 1976 and *Research Disclosure* 15654, April, 1977, the disclosures of which are hereby incorporated by reference.

In a preferred embodiment of our invention, the dye-releasers such as those in the Fleckenstein et al patent referred to above are employed. Such compounds are ballasted sulfonamido compounds which are alkali-cleavable upon oxidation to release a diffusible dye from the nucleus and have the formula:

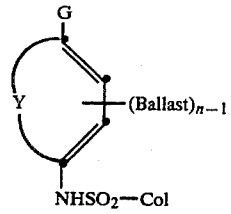

wherein:

(a) Col is a dye or dye precursor moiety;

(b) Ballast is an organic ballasting radical of such molecular size and configuration (e.g., simple organic groups or polymeric groups) as to render the compound nondiffusible in the photosensitive element during development in an alkaline processing composition;

(c) G is $OR^4$ or $NHR^5$ wherein $R^4$ is hydrogen or a hydrolyzable moiety and $R^5$ is hydrogen or a substituted or unsubstituted alkyl group of 1 to 22 carbon atoms, such as methyl, ethyl, hydroxyethyl, propyl, butyl, secondary butyl, tertiary butyl, cyclopropyl, 4-chlorobutyl, cyclobutyl, 4-nitroamyl, hexyl, cyclohexyl, octyl, decyl, octadecyl, docosyl, benzyl or phenethyl (where $R^5$ is an alkyl group of greater than 6 carbon atoms, it can serve as a partial or sole Ballast group);

(d) Y represents the atoms necessary to complete a benzene nucleus, a naphthalene nucleus or a 5- to 7-membered heterocyclic ring such as pyrazolone or pyrimidine; and (e) n is a positive integer or 1 to 2 and is 2 when G is $OR^4$ or when $R^5$ is a hydrogen or an alkyl group of less than 8 carbon atoms.

For further details concerning the above described sulfonamido compounds and specific examples of same, reference is made to the above-mentioned Fleckenstein et al U.S. Pat. No. 4,076,529 referred to above.

In another preferred embodiment of our invention, positive-working, nondiffusible RDR's of the type disclosed in U.S. Pat. Nos. 4,139,379 and 4,139,389 are employed. In this embodiment, an immobile compound is employed which as incorporated in a photographic element is incapable of releasing a diffusible dye. However, during photographic processing under alkaline conditions, the compound is capable of accepting at least one electron (i.e., being reduced) and thereafter releases a diffusible dye. These immobile compounds are ballasted electron accepting nucleophilic displacement compounds.

The photographic element in the abovedescribed photographic assemblage is treated with an alkaline processing composition to effect or initiate development in any manner. One method for applying processing composition is by interjecting processing solution with communicating members similar to hypodermic syringes which are attached either to a camera or camera cartridge. The processing composition can also be applied by means of a swab or by dipping in a bath, if so desired. Another method of applying processing composition to a film assemblage which can be used in our invention is the liquid spreading means described in U.S. application Ser. No. 143,230 of Columbus, filed Apr. 24, 1980.

In a preferred embodiment of the invention, the assemblage itself contains the alkaline processing composition and means containing same for discharge within the film unit. There can be employed, for example, a rupturable container which is adapted to be positioned during processing of the film unit so that a compressive force applied to the container by pressure-applying members, such as would be found in a camera designed for in-camera processing, will effect a discharge of the container's contents within the film unit.

The dye image-receiving layer in the above-described film assemblage is optionally located on a separate support adapted to be superposed on the photographic element after exposure thereof. Such image-receiving elements are generally disclosed, for example, in U.S. Pat. No. 3,362,819. In accordance with this embodiment of our invention, the dye image-receiving element would comprise a support having thereon, in sequence, a neutralizing layer, as described previously, a timing layer and a dye image-receiving layer. When the means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

The dye image-receiving layer in the above described film assemblage in another embodiment is integral with the photographic element between the support and the lowermost photosensitive silver halide emulsion layer. One useful format for integral receiver-negative photographic elements is disclosed in Belgian Pat. No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer, and dye images, formed as a function of development, diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention is employed is disclosed in Canadian Pat. No. 928,559. In this embodiment, the support for the photographic element is transparent and is coated with the image-receiving layer, a substantially opaque, light-reflective layer and the photosensitive layer or layers described above. A rupturable container, containing an alkaline processing composition and an opacifier, is positioned between the top layer and a transparent cover sheet which has thereon, in sequence, a neutralizing layer, as described previously and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photosensitive silver halide emulsion is coated on an opaque support and a dye image-receiving layer is located on a separate transparent support superposed over the layer outermost from the opaque support. In addition, this transparent support also contains a neutralizing layer as described above and a timing layer underneath the dye image-receiving layer.

In another embodiment of the invention, the neutralizing layer described above and timing layer are located underneath the photosensitive layer or layers. In that embodiment, the photographic element would comprise a support having thereon, in sequence, a neutralizing layer, as described above, a timing layer and at least one photosensitive silver halide emulsion layer having associated therewith a dye image-providing material. A dye image-receiving layer would be provided on a second support with the processing composition being applied therebetween. This format could either be integral, as described above, or peel-apart such as the two sheet image transfer elements described previously. In the latter format, an interlayer is preferably employed between the neutralizing layer and the timing layer. Such an interlayer can comprise a mixture of the neutralizing layer polymer described above and a vinylidene chloride copolymer, each polymer being coated at 0.1 to 2.5 $g/m^2$, preferably from 0.2 to 1.5 $g/m^2$.

Preferred vinylidene chloride copolymers useful in the interlayer described above include the following:

Poly(acrylonitrile-co-vinylidene chloride-co-acrylic acid) (weight ratio 14/79/7)

Poly(acrylonitrile-co-vinylidene chloride-co-acrylic acid) (weight ratio 10/85/5)

Poly(acrylonitrile-co-vinylidene chloride-co-acrylic acid) (weight ratio 12/68/20)

Poly(monobutyl itaconate-co-vinylidene chloride) (weight ratio 9/91)

Poly(methyl acrylate-co-vinylidene chloride-co-itaconic acid) (weight ratio 15/83/2)

Another embodiment of the invention uses the image-reversing technique disclosed in British Pat. No. 904,364, page 19, lines 1 through 41. In this process, the dye-releasing compounds are used in combination with physical development nuclei in a nuclei layer contiguous to the photosensitive silver halide negative emulsion layer. The film unit contains a silver halide solvent, preferably in a rupturable container with the alkaline processing composition.

A process for producing a photographic transfer image in color according to our invention from an imagewise exposed photosensitive element comprising a support having thereon at least one photosensitive silver halide emulsion layer having associated therewith a dye image-providing material comprises treating the element with an alkaline processing composition in the presence of a silver halide developing agent to effect development of each of the exposed silver halide emulsion layers. The processing composition contacts the emulsion layer or layers prior to contacting a neutralizing layer as described above. An imagewise distribution of dye image-providing material is thus formed as a function of development, and at least a portion of it diffuses to a dye image-receiving layer to provide the transfer image. A timing layer associated with the neutralizing layer is permeated by the alkaline processing composition after a predetermined time, the timing layer being located between the neutralizing layer and the dye image-receiving layer and the photosensitive silver halide emulsion layer so that the processing composition must first permeate the timing layer before contacting the neutralizing layer. The alkaline processing composition is then neutralized by means of the neutralizing layer associated with the timing layer after the predetermined time.

The film unit or assemblage of the present invention is used to produce positive images in single or multicolors. In a three-color system, each silver halide emulsion layer of the film assembly will have associated therewith a dye image-providing material which possesses a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith and the red-sensitive silver halide emulsion layer will have a cyan dye image-providing material associated therewith. The dye image-providing material associated with each silver halide emulsion layer is contained either in the silver halide emulsion layer itself or in a layer contiguous to the silver halide emulsion layer, i.e., the dye image-providing material can be coated in a separate layer underneath the silver halide emulsion layer with respect to the exposure direction.

The concentration of the dye image-providing material that is employed in the present invention can be varied over a wide range, depending upon the particular compound employed and the results desired. For example, the dye image-providing material coated in a layer at a concentration of 0.1 to 3 $g/m^2$ has been found to be useful. The dye image-providing material is dispersed in a hydrophilic film forming natural material or synthetic polymer, such as gelatin, polyvinyl alcohol, etc, which is adapted to be permeated by aqueous alkaline processing composition.

A variety of silver halide developing agents are useful in this invention. Specific examples of developers or electron transfer agents (ETA's) useful in this invention include hydroquinone compounds, such as hydroquinone, 2,5-dichlorohydroquinone or 2-chlorohydroquinone; aminophenol compounds, such as 4-aminophenol, N-methylaminophenol, N,N-dimethylaminophenol, 3-methyl-4-aminophenol or 3,5-dibromoaminophenol; catechol compounds, such as catechol, 4-cyclohexylcatechol, 3-methoxycatechol, or 4-(N-octadecylamino)-catechol; phenylenediamine compounds, such as N,N,N',N'-tetramethyl-p-phenylenediamine. In highly preferred embodiments, the ETA is a 3-pyrazolidinone compound, such as 1-phenyl-3-pyrazolidinone (Phenidone, trademark), 1-phenyl-4,4-dimethyl-3-pyrazolidinone (Dimezone, trademark), 4-hydroxymethyl-4-methyl-1-phenyl-3-pyrazolidinone, 4-hydroxymethyl-4-methyl-1-p-tolyl-3-pyrazolidinone, 4-hydroxymethyl-4-methyl-1-(3,4-xylyl)-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-dihydroxymethyl-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone or 5-methyl-3-pyrazolidinone. A combination of different ETA's, such as those disclosed in U.S. Pat. No. 3,039,869, can also be employed. These ETA's are employed in the liquid processing composition or contained, at least in part, in any layer or layers of the photographic element or film unit to be activated by the alkaline processing composition, such as in the silver halide emulsion layers, the dye image-providing material layers, interlayers, image-receiving layer, etc.

In our invention, dye image-providing materials can be used which produce diffusible dye images as a function of development. Either conventional negative-working or direct-positive silver halide emulsions are employed. If the silver halide emulsion employed is a direct-positive silver halide emulsion, such as an internal image emulsion designed for use in the internal image reversal process, or a fogged, direct-positive emulsion such as a solarizing emulsion, which is developable in unexposed areas, a positive image can be obtained on the dye image-receiving layer by using ballasted, redox, dye-releasers. After exposure of the film unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-catalyzed reaction to release the dyes imagewise as a function of the imagewise exposure of each of the silver halide emulsion layers. At least a portion of the imagewise distributions of diffusible dyes diffuse to the image-receiving layer to form a positive image of the original subject.

Internal image silver halide emulsions useful in this invention are described more fully in the November, 1976 edition of *Research Disclosure,* pages 76 through 79, the disclosure of which is hereby incorporated by reference.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymer interlayers, e.g., gelatin, are about 0.2 to 5 microns in thickness. Of course, these thicknesses are approximate only and can be modified according to the product desired.

Scavengers for oxidized devloping agent can be employed in various interlayers of the photographic elements of the invention. Suitable materials are disclosed on page 83 of the November 1976 edition of *Research Disclosure,* the disclosure of which is hereby incorporated by reference.

Any material is useful as the image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November, 1976 edition of *Research Disclosure,* the disclosure of which is hereby incorporated by reference.

Any material can be employed as the timing layer in this invention as long as it performs the intended function to time or control the pH reduction as a function of the rate at which alkali diffuses through this layer. Examples of such timing layers and their functioning are disclosed on pages 22 and 23 of the July, 1974 edition of *Research Disclosure,* and pages 35 through 37 of the July, 1975 edition of *Research Disclosure,* the disclosures of which are hereby incorporated by reference.

The alkaline processing composition employed in this invention is the conventional aqueous solution of an alkaline material, e.g., alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November, 1976 edition of *Research Disclosure,* the disclosure of which is hereby incorporated by reference.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of the three primary regions of the spectrum can be disposed as a single segmented layer, e.g., as by the use of microvessels, as described in Whitmore U.S. patent application Ser. No. 184,714, filed Sept. 8, 1980.

The silver halide emulsions useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

*Research Disclosure* is a publication of Industrial Opportunities Ltd.; Homewell, Havant; Hampshire, P09 1EF, United Kingdom.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1

Synthesis of Poly[n-butyl acrylate-co-acrylic acid-co-N-(isobutoxymethyl)-acrylamide], 20:70:10 weight ratio A mixture of 3800 g acetone and 1900 g distilled water were added to a 12 l flask equipped with a stirrer and condenser. The mixture was degassed with nitrogen for 15 minutes and placed in a 60° C. bath. Next 13.0 g 2,2'-azobis(2-methylpropionitrile) were added. Immediately afterwards a mixture of 200 g n-butyl acrylate, 700 g acrylic acid, and 118 g of an 85 percent solution of N-(isobutoxymethyl)acrylamide were added from a 2 l header flask over a period of 40 minutes. The resulting polymer solution was then stirred at 60° C. for 16 hours. The clear viscous polymer solution was then cooled and the polymer was precipitated in 56 l of distilled water. The "soft-taffy" product was washed twice with distilled water and redissolved in 4.8 l of acetone to give a clear viscous solution containing 10.9 percent solids.

EXAMPLE 2

Swell Characteristics—Physical Integrity (A) A control element was prepared by coating on a poly(ethylene terephthalate) film support a neutralizing layer of poly(n-butyl acrylate-co-acrylic acid) (30:70 weight ratio) equivalent to 81 meq. acid/m$^2$, hardened with 1,4-butanediol di-glycidyl ether.

(B) Another control element was prepared by coating on a poly(ethylene terephthalate) film support a neutralizing layer of poly[n-butyl acrylate-co-acrylic acid-co-N-(isobutoxymethyl)acrylamide] (20:70:10 weight ratio) equivalent to 48 meq. acid/m$^2$ (unhardened).

(C) An element employing the neutralizing layer of the invention was prepared similar to (B) except that it was hardened with 1.5 percent p-toluene-sulfonic acid.

The above coatings were prepared from 80/20 acetone/water solutions of the indicated polymer using conventional coating techniques. Drying was for a total of 5.5 minutes, stepped from 77° C. to 21° C. (dry bulb).

The swell of each coating in μm was measured using standard techniques with a probe-type hydraulic swellometer by immersing in an activator of the following composition:

| | |
|---|---|
| Potassium hydroxide | 0.6 N |
| 5-Methylbenzotriazole | 3.0 g/l |
| 11-Aminoundecanoic acid | 2.0 g/l |
| Potassium bromide | 2.0 g/l |

The swellometer was similar to the one described by F. M. Flynn and H. A. Levine in *Photogr. Sci. and Engr.*, 8, 275 (1964). The following results were obtained:

TABLE I

| Element | Neutralizing Layer | Hardened | Swell (μm) 5 sec | 10 sec | 20 sec | 30 sec | 40 sec | 50 sec |
|---|---|---|---|---|---|---|---|---|
| A (Control) | poly(n-butyl acrylate-co-acrylic acid) | Yes | 15 | 22 | 45 | 90 | * | * |
| B (Control) | poly[n-butyl acrylate-co-acrylic acid-co-N—isobutoxymethyl)acrylamide] | No | 25 | * | * | * | * | * |
| C | poly[n-butyl acrylate-co-acrylic acid-co-N—isobutoxymethyl)acrylamide] | Yes | 15 | 21 | 21 | 22 | 22 | 22 |

*Coating lost physical integrity.

The above data indicates that Element C employing the neutralizing layer according to the invention has superior swell characteristics (smaller amount of swell) compared to the Control Element A, which also lost physical integrity after 30 sec. The data also indicates that the neutralizing layer according to the invention must be hardened in order to maintain physical integrity (Element C compared to Element B, which lost physical integrity after 5 sec). Good physical integrity is necessary for adhering other layers on top of a neutralizing layer.

EXAMPLE 3

Photosensitive Element Test

Photosensitive (donor) elements were prepared by coating the following layers in the order recited on an opaque poly(ethylene terephthalate) film support:

(1) Neutralizing layer of Example 2, Elements A and C
(2) Interlayer—See Table II
(3) Timing layer
(4) Interlayer of "gel nitrate"
(5) Cyan redox dye-releaser layer
(6) Red-sensitive, negative-working, silver halide emulsion layer
(7) Interlayer with incorporated developer
(8) Magenta redox dye-releaser layer
(9) Green-sensitive, negative-working, silver halide emulsion layer
(10) Interlayer with incorporated developer
(11) Yellow redox dye-releaser layer
(12) Blue-sensitive, negative-working, silver halide emulsion layer
(13) Gelatin overcoat layer The timing layer comprised a 1:9 physical mixture by weight of poly(acrylonitrile-co-vinylidene chloride-co-acrylic acid latex) (weight ratio of 14/79/7) and a lactone polymer, partially hydrolyzed and 1-butanol transesterified poly(vinyl acetate-co-maleic anhydride), ratio of acid/butyl ester 15/85.

The "gel nitrate" composition consisted of the following (by weight):

0.61 percent gelatin
0.29 percent cellulose nitrate
0.06 percent salicylic acid
0.01 percent chromium chloride
1.2 percent water
77.8 percent acetone 20.0 percent methanol The redox dye-releasers were similar to those described in *Research Disclosure*, Vol. 182, July 1979, Item 18268, pages 329 through 331. The silver halide emulsion layers were conventional negative-working, 0.25 to 0.65μ silver chloride emulsions. The incorporated developer was a 3-position blocked 1-phenyl-3-pyrazolidinone. The total gelatin coverage in layers 5 to 13 was 8.1 g/m$^2$, hardened with 0.75 percent bis(vinylsulfonyl)methyl ether.

A dye image-receiving element was then prepared by coating the following layers in the order recited on an opaque paper support.

(1) Gelatin (0.81 g/m$^2$) plus formaldehyde equal to 1.25 percent of the total gelatin weight;
(2) Dye image-receiving layer of poly[styrene-co-1-vinylimidazole-co-3-(2-hydroxyethyl)-1-vinylimidazolium chloride] (weight ratio 50:40:10) (2.4 g/m$^2$); sorbitol (0.54 g/m$^2$) and gelatin (3.0 g/m$^2$);
(3) Interlayer of 2-(2-hydroxy-3,5-di-t-amylphenyl)benzotriazole (0.54 g/m$^2$) and gelatin (0.86 g/m$^2$); and
(4) Gelatin (0.65 g/m$^2$) containing zinc sulfate (0.04 g/m$^2$).

Samples of the above donor elements were flashed to maximum density, soaked in the activator solution of Example 2 contained in a shallow tray processor for 15 seconds at 28° C., and then laminated between nip rollers to dry samples of the dye image-receiving element. After either 4 or 10 minutes, the donor and receiver were pulled apart. The extent of areas of emulsion and/or timing layer, if any, from the donor which have transferred to the receiver was estimated visually as follows:

TABLE II

| Neutralizing Layer (hardened) (meq. acid/m$^2$) | Interlayer (g/m$^2$) | Percent of Emulsion Areas Transferred to Receiver | |
|---|---|---|---|
| | | 4 min. Lamination | 10 min. Lamination |
| A - poly(n-butyl acrylate-co-acrylic acid (30:70 wt. ratio) (81) (Control) | A (0.81)/ *C (0.54) | 0 | 15 |
| B - poly[n-butyl acrylate-co-acrylic acid-co-N—(isobutoxymethyl)acrylamide] (20:70:10 wt. ratio) (48) | None | 100 | 100 |
| B - poly[n-butyl acrylate-co-acrylic acid-co-N—(isobutoxymethyl)acrylamide] (20:70:10 wt. ratio) (48) | A (0.81)/ *C (0.54) | 100 | 40 |
| B - poly[n-butyl acrylate-co-acrylic acid-co-N—(isobutoxymethyl)acrylamide] (20:70:10 wt. ratio) (48) | B (0.81)/ *C (0.54) | 0 | 0 |

*C = poly(acrylonitrile-co-vinylidene chloride-co-acrylic acid (12:68:20 weight ratio)

The above data indicate that photosensitive elements containing an interlayer of a mixture of a vinylidene chloride copolymer and the neutralizing layer according to the invention exhibit no emulsion areas transferred to the receiver at both a 4 and a 10 minute lamination. This result is better than that obtained with other interlayers or no interlayer, and is also better than the control prior art neutralizing layer.

It should also be noted that the control element coated at less than 81 meq. acid/m$^2$ showed poor physical integrity and was not useable for testing.

EXAMPLE 4

TLB Determination on Cover Sheet (A) A control cover sheet was prepared by coating the following layers in the order recited on an opaque poly(ethylene terephthalate) film support:

(1) a neutralizing layer of poly(n-butyl acrylate-co-acrylic acid) (30:70 weight ratio) equivalent to 81 meq. acid/m$^2$, hardened with 7.5 percent 1,4-butanediol diglycidyl ether;
(2) an interlayer comprising poly(n-butyl acrylate-co-acrylic acid) (30:70 weight ratio) (0.81 g/m$^2$) and poly(acrylonitrile-co-vinylidene chloride-co-acrylic acid) (12:68:20 weight ratio) (0.54 g/m$^2$); and
(3) a timing layer as described in Example 3.

(B) A cover sheet according to the invention was prepared by coating the following layers in the order recited on an opaque poly(ethylene terephthalate) film support:

(1) a neutralizing layer of poly[n-butyl acrylate-co-acrylic acid-co-N-(isobutoxymethyl)acrylamide] (20:70:10 weight ratio) equivalent to 81 meq. acid/m$^2$, hardened with 1.5 percent p-toluene-sulfonic acid;
(2) an interlayer comprising poly[n-butyl acrylate-co-acrylic acid-co-N-(isobutoxymethyl)acrylamide] (20:70:10 weight ratio) (0.81 g/m$^2$) and poly(acrylonitrile-co-vinylidene chloride-co-acrylic acid) (12:68:20 weight ratio) (0.54 g/m$^2$); and
(3) a timing layer as described in Example 3.

(C) A cover sheet similar to B was prepared except that layer 1 coverage was equivalent to 48 meq. acid/m$^2$.

An indicator sheet was prepared consisting of thymolphthalein dye in a gelatin layer coated on a transparent support.

Samples of the indicator sheet were soaked in the activator of Example 1 for 15 seconds at 28° C. and then laminated to samples of the above cover sheets by laminating between nip rollers. The change in color of the dye from blue to colorless indicates the TLB (Timing Layer Breakdown) or time required to lower the pH below 12. Samples of the cover sheet were also incubated for various times and conditions as shown in the following table:

TABLE III

| Cover Sheet | Neutralizing Layer (hardened) | TLB (sec) | | | |
|---|---|---|---|---|---|
| | | Fresh | 2 Weeks Room Keep | 3 Days 32° C./ 90% RH | 7 Days 50° C./ 50% RH |
| A (Control) | poly(n-butyl acrylate-co-acrylic acid (81 meq. acid/m$^2$) | 41 | 47 (+15%) | 64 (+56%) | 65 (+60%) |
| B | poly[n-butyl- | 52 | 54 | 54 | 55 |

TABLE III-continued

| Cover Sheet | Neutralizing Layer (hardened) | Fresh | TLB (sec) 2 Weeks Room Keep | 3 Days 32° C./ 90% RH | 7 Days 50° C./ 50% RH |
|---|---|---|---|---|---|
| | acylate-co-acrylic acid-co-N—isobutoxymethyl)acrylamide] (81 meq. acid/$m^2$) | | (+4%) | (+4%) | (+6%) |
| C | poly[n-butylacrylate-co-acrylic acid-co-N—isobutoxymethyl)acrylamide] (48 meq. acid/$m^2$) | 52 | 55 (+6%) | 53 (+2%) | 55 (+6%) |

The above data indicate that use of the neutralizing layer according to the invention results in a much more stable TLB than the neutralizing layer in the control element of the prior art. The difference is believed to be due to the fact that unreacted epoxide or other species of the hardening agent in the control element can migrate out of the neutralizing layer to affect the TLB. In using the neutralizing layer of the invention, however, heat or an innocuous acid catalyst is used to internally cross-link the neutralizing layer, so that there is no unreacted species which can wander to the timing layer of affect TLB.

The invention has been described in detail with particular reference to preferred embodiments thereof, but it will be understood that variations and modifications can be effected within the spirit and scope of the invention.

What is claimed is:

1. In a photographic assemblage comprising:

(a) a support having thereon at least one photosensitive silver halide emulsion layer having associated therewith a dye image-providing material;

(b) a dye image-receiving layer;

(c) a neutralizing layer for neutralizing an alkaline processing composition; and (d) a timing layer located between said neutralizing layer and said dye image-receiving layer so that said processing composition must first permeate said timing layer before contacting said neutralizing layer;

the improvement wherein said neutralizing layer comprises a cross-linked polymer derived from:

(i) 5 to 30 weight percent of recurring units which conform to the structure:

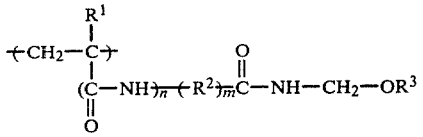

wherein $R^1$ is hydrogen or methyl, $R^2$ is alkylene, arylenealkylene, alkylenebisarylene, arylenebisalkylene or arylene, $R^3$ is an alkyl group of 1 to about 10 carbon atoms, and n and m are 0 or 1 with the proviso that when m is 0, then n is 0, and when m is 1, then n is 0 or 1;

(ii) 30 to 80 weight percent of recurring units derived from a substituted or unsubstituted acrylic acid; and (iii) 5 to 30 weight percent of recurring units derived from an alkyl acrylic ester wherein the alkyl group has from 1 to about 16 carbon atoms.

2. The assemblage of claim 1 wherein n and m are each 0.

3. The assemblage of claim 2 wherein $R^1$ is hydrogen and $R^3$ is an isobutyl group.

4. The assemblage of claim 1 wherein said acid moiety of said polymer is either acrylic acid or methacrylic acid.

5. The assemblage of claim 1 wherein said alkyl acrylic ester moiety of said polymer comprises an alkyl acrylate or methacrylate wherein said alkyl group has from 1 to about 6 carbon atoms.

6. The assemablage of claim 5 wherein said alkyl acrylic ester comprises butyl acrylate.

7. The assemblage of claim 1 wherein said polymer comprises poly[N-(isobutoxymethyl)acrylamide-co-acrylic acid-co-n-butyl acrylate] (10:70:20 weight ratio).

8. In a photographic assemblage comprising:

(a) a photosensitive element comprising a support having thereon at least one photosensitive silver halide emulsion layer having associated therewith a dye image-providing material;

(b) a dye image-receiving layer;

(c) an alkaline processing composition and means containing same for discharge within said assemblage;

(d) a neutralizing layer for neutralizing said alkaline processing composition; and (e) a timing layer located between said neutralizing layer and said dye image-receiving layer so that said processing composition must first permeate said timing layer before contacting said neutralizing layer;

the improvement wherein said neutralizing layer comprises a cross-linked polymer derived from:

(i) 5 to 30 weight percent of recurring units which conform to the structure:

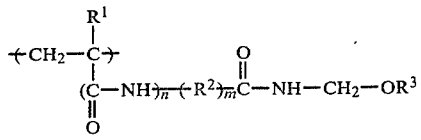

wherein $R^1$ is hydrogen or methyl, $R^2$ is alkylene, arylenealkylene, alkylenebisarylene, arylenebisalkylene or arylene, $R^3$ is an alkyl group of 1 to about 10 carbon atoms, and n and m are 0 or 1 with the proviso that when m is 0, then n is 0, and when m is 1, then n is 0 or 1;

(ii) 30 to 80 weight percent of recurring units derived from a substituted or unsubstituted acrylic acid; and (iii) 5 to 30 weight percent of recurring units derived from an alkyl acrylic ester wherein the alkyl group has from 1 to about 16 carbon atoms.

9. The assemblage of claim 8 wherein n and m are each 0.

10. The assemblage of claim 9 wherein $R^1$ is hydrogen and $R^3$ is an isobutyl group.

11. The assemblage of claim 8 wherein said acid moiety of said polymer is either acrylic acid or methacrylic acid.

12. The assemblage of claim 8 wherein said alkyl acrylic ester moiety of said polymer comprises an alkyl acrylate or methacrylate wherein said alkyl group has from 1 to about 6 carbon atoms.

13. The assemblage of claim 12 wherein said alkyl acrylic ester comprises butyl acrylate.

14. The assemblage of claim 8 wherein said polymer comprises poly[N-(isobutoxymethyl)acrylamide-co-acrylic acid-co-n-butyl acrylate] (10:70:20 weight ratio).

15. The assemblage of claim 8 wherein:

(a) said dye image-receiving layer is located in said photosensitive element between said support and said silver halide emulsion layer; and (b) said assemblage also includes a transparent cover sheet over the layer outermost from said support.

16. The assemblage of claim 15 wherein said transparent cover sheet is coated with, in sequence, said neutralizing layer and said timing layer.

17. The assemblage of claim 16 wherein said discharging means is a rupturable container containing said alkaline processin composition and an opacifying agent, said container being so positioned during processing of said assemblage that a compressive force applied to said container will effect a discharge of the container's contents between said transparent sheet and the layer outermost from said support.

18. The assemblage of claim 8 wherein said support of said photosensitive element is opaque, and said dye image-receiving layer is located on a separate transparent support superposed on the layer outermost from said opaque support.

19. The assemblage of claim 18 wherein said transparent support has thereon, in sequence, said neutralizing layer, said timing layer and said dye image-receiving layer.

20. The assemblage of claim 18 wherein said opaque support has thereon, in sequence, said neutralizing layer, said timing layer and said silver halide emulsion layer.

21. The assemblage of claim 8 wherein said dye image-providing material is a redox dye-releaser.

22. The assemblage of claim 8 wherein said dye image-providing material is a ballasted sulfonamido compound which is alkali-cleavable upon oxidation to release a diffusible color-providing moiety, said compound having the formula:

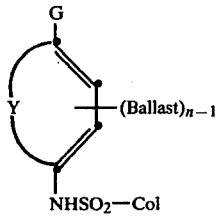

wherein:

(a) Col is a dye or dye precursor moiety;

(b) Ballast is an organic ballasting radical of such molecular size and configuration as to render said compound nondiffusible in said photosensitive element during development in an alkaline processing composition;

(c) G is $OR^4$ *l or NHR5* wherein $R^4$ is hydrogen or a hydrolyzable moiety and $R^5$ is hydrogen or an alkyl group of 1 to 22 carbon atoms;

(d) Y represents the atoms necessary to complete a benzene nucleus, a naphthalene nucleus or a 5- to 7-membered heterocyclic ring; and (e) n is a positive integer of 1 to 2 and is 2 when G is $OR^4$ or when $R^5$ is hydrogen or an alkyl group of less than 8 carbon atoms.

23. The assemblage of claim 8 wherein said photosensitive element comprises a support having thereon a red-sensitive silver halide emulsion layer having a cyan dye image-providing material associated therewith, a green-sensitive silver halide emulsion layer having a magenta dye image-providing material associated therewith, and a blue-sensitive silver halide emulsion layer having a yellow dye image-providing material associated therewith.

24. An integral photographic assemblage comprising:

(a) a photosensitive element comprising a transparent support having thereon the following layers in sequence: a dye image-receiving layer; an alkaline solution-permeable, light-reflective layer; an alkaline solution-permeable, opaque layer; a red-sensitive, direct-positive silver halide emulsion layer having a ballasted redox cyan dye-releaser associated therewith; a green-sensitive, direct-positive silver halide emulsion layer having a ballasted redox magenta dye-releaser associated therewith; and a blue-sensitive, direct-positive silver halide emulsion layer having a ballasted redox yellow dye-releaser associated therewith;

(b) a transparent sheet superposed over said blue-sensitive silver halide emulsion layer and comprising a transparent support coated with, in sequence, a neutralizing layer and a timing layer; and (c) a rupturable container containing an alkaline processing composition and an opacifying agent, said container being so positioned during processing of said assemblage that a compressive force applied to said container will effect a discharge of the container's contents between said timing layer and said blue-sensitive silver halide emulsion layer;

said assemblage containing a silver halide developing agent, the improvement wherein said neutralizing layer comprises a cross-linked polymer derived from:

(i) 5 to 30 weight percent of recurring units which conform to the structure:

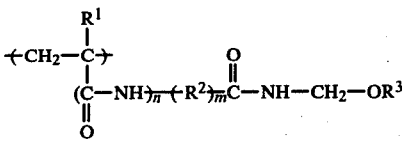

wherein $R^1$ is hydrogen or methyl, $R^2$ is alkylene, arylenealkylene, alkylenebisarylene, arylenebisalkylene or arylene, $R^3$ is an alkyl group of 1 to about 10 carbon atoms, and n and m are 0 or 1 with the proviso that when m is 0, then n is 0, and when m is 1, then n is 0 or 1;

(ii) 30 to 80 weight percent of recurring units derived from a substituted or unsubstituted acrylic acid; and (iii) 5 to 30 weight percent of recurring units derived from an alkyl acrylic ester wherein the alkyl group has from 1 to about 16 carbon atoms.

25. In a process for producing a photographic transfer image in color from an imagewise-exposed photosensitive element comprising a support having thereon at least one photosensitive silver halide emulsion layer having associated therewith a dye image-providing material, said process comprising treating said element with an alkaline processing composition in the presence of a silver halide developing agent to effect development of each of said exposed silver halide emulsion layers, said processing composition contacting said emulsion layer prior to contacting a neutralizing layer, whereby an imagewise distribution of dye image-providing material is formed as a function of development and at least a portion of it diffuses to a dye image-receiving layer to provide said transfer image, a timing layer associated with said neutralizing layer being permeated by said alkaline processing composition after a predetermined time, said timing layer being located between said neutralizing layer and said dye image-receiving layer so that said processing composition must first permeate said timing layer before contacting said neutralizing layer, whereby said alkaline processing composition is neutralized by means of said neutralizing layer associated with said timing layer after said predetermined time;

the improvement wherein said neutralizing layer comprises a cross-linked polymer derived from:

(i) 5 to 30 weight percent of recurring units which conform to the structure:

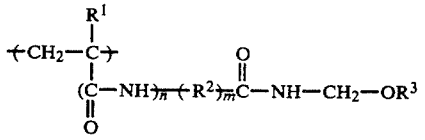

wherein $R^1$ is hydrogen or methyl, $R^2$ is alkylene, arylenealkylene, alkylenebisarylene, arylenebisalkylene or arylene, $R^3$ is an alkyl group of 1 to about 10 carbon atoms, and n and m are 0 or 1 with the proviso that when m is 0, L then n is 0, and when m is 1, then n is 0 or 1;

(ii) 30 to 80 weight percent of recurring units derived from a substituted or unsubstituted acrylic acid; and (iii) 5 to 30 weight percent of recurring units derived from an alkyl acrylic ester wherein the alkyl group has from 1 to about 16 carbon atoms.

26. The process of claim 25 wherein n and m are each 0.

27. The process of claim 26 wherein $R^1$ is hydrogen and $R^3$ is an isobutyl group.

28. The process of claim 25 wherein said acid moiety of said polymer is either acrylic acid or methacrylic acid.

29. The process of claim 25 wherein said alkyl acrylic ester moiety of said polymer comprises an alkyl acrylate or methacrylate wherein said alkyl group has from 1 to about 6 carbon atoms.

30. The process of claim 29 wherein said alkyl acrylic ester comprises butyl acrylate.

31. The process of claim 25 wherein said polymer comprises poly[N-(isobutoxymethyl)acrylamide-co-acrylic acid-co-n-butyl acrylate] (10:70:20 weight ratio).

32. In a dye image-receiving element adapted to be permeated by an alkaline processing composition comprising a support having thereon, in sequence, a neutralizing layer, a timing layer and a dye image-receiving layer, the improvement wherein said neutralizing layer comprises a cross-linked polymer derived from:

(i) 5 to 30 weight percent of recurring units which conform to the structure:

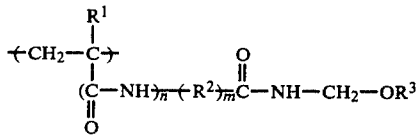

wherein $R^1$ is hydrogen or methyl, $R^2$ is alkylene, arylenealkylene, alkylenebisarylene, arylenebisalkylene or arylene, $R^3$ is an alkyl group of 1 to about 10 carbon atoms, and n and m are 0 or 1 with the proviso that when m is 0, then n is 0, and when m is 1, then n is 0 or 1;

(ii) 30 to 80 weight percent of recurring units derived from a substituted or unsubstituted acrylic acid; and (iii) 5 to 30 weight percent of recurring units derived from an alkyl acrylic ester wherein the alkyl group has from 1 to about 16 carbon atoms.

33. The element of claim 32 wherein n and m are each 0.

34. The element of claim 33 wherein $R^1$ is hydrogen and $R^3$ is an isobutyl group.

35. The element of claim 32 wherein said acid moiety of said polymer is either acrylic acid or methacrylic acid.

36. The element of claim 32 wherein said alkyl acrylic ester moiety of said polymer comprises an alkyl acrylate or methacrylate wherein said alkyl group has from 1 to about 6 carbon atoms.

37. The element of claim 36 wherein said alkyl acrylic ester comprises butyl acrylate.

38. The element of claim 32 wherein said polymer comprises poly[N-(isobutoxymethyl)acrylamide-co-acrylic acid-co-n-butyl acrylate] (10:70:20 weight ratio).

39. In a cover sheet adapted to be permeated by an alkaline processing composition, comprising a transparent support having thereon, in sequence, a neutralizing layer and a timing layer, the improvement wherein said neutralizing layer comprises a cross-linked polymer derived from:

(i) 5 to 30 weight percent of recurring units which conform to the structure:

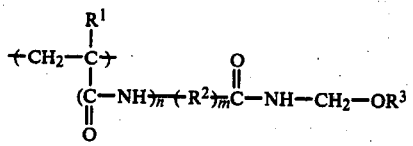

wherein $R^1$ is hydrogen or methyl, $R^2$ is alkylene, arylenealkylene, alkylenebisarylene, arylenebisalkylene or arylene, $R^3$ is an alkyl group of 1 to about 10 carbon atoms, and n and m are 0 or 1 with the proviso that when m is 0, then n is 0, and when m is 1, then n is 0 or 1;

(ii) 30 to 80 weight percent of recurring units derived from a substituted or unsubstituted acrylic acid; and (iii) 5 to 30 weight percent of recurring units derived from an alkyl acrylic ester wherein the alkyl group has from 1 to about 16 carbon atoms.

40. The cover sheet of claim 39 wherein n and m are each 0.

41. The cover sheet of claim 40 wherein $R^1$ is hydrogen and $R^3$ is an isobutyl group.

42. The cover sheet of claim 39 wherein said acid moiety of said polymer is either acrylic acid or methacrylic acid.

43. The cover sheet of claim 39 wherein said alkyl acrylic ester moiety of said polymer comprises an alkyl acrylate or methacrylate wherein said alkyl group has from 1 to about 6 carbon atoms.

44. The cover sheet of claim 43 wherein said alkyl acrylic ester comprises butyl acrylate.

45. The cover sheet of claim 39 wherein said polymer comprises poly[N-(isobutoxymethyl)acrylamide-co-acrylic acid-co-n-butyl acrylate] (10:70:20 weight ratio).

46. A photographic element adapted to be permeated by an alkaline processing composition comprising a support having thereon, in sequence, a neutralizing layer, a timing layer, and at least one photosensitive silver halie emulsion layer having associated therewith a dye image-providing material, the improvement wherein said neutralizing layer comprises a cross-linked polymer derived from:

(i) 5 to 30 weight percent of recurring units which conform to the structure:

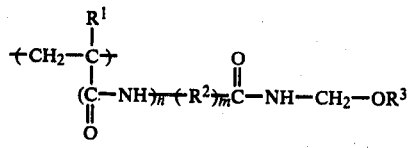

wherein $R^1$ is hydrogen or methyl, $R^2$ is alkylene, arylenealkylene, alkylenebisarylene, arylenebisalkylene or arylene, $R^3$ is an alkyl group of 1 to about 10 carbon atoms, and n and m are 0 or 1 with the proviso that when m is 0, then n is 0, and when m is 1, then n is 0 or 1;

(ii) 30 to 80 weight percent of recurring units derived from a substituted or unsubstituted acrylic acid; and (iii) 5 to 30 weight percent of recurring units derived from an alkyl acrylic ester wherein the alkyl group has from 1 to about 16 carbon atoms.

47. The element of claim 46 which contains an interlayer between said neutralizing layer and said timing layer, said interlayer comprising a mixture of said neutralizing layer polymer which has not been cross-linked and a vinylidene chloride copolymer.

48. The element of claim 46 wherein n and m are each 0.

49. The element of claim 48 wherein $R^1$ is hydrogen and $R^3$ is an isobutyl group.

50. The element of claim 46 wherein said acid moiety of said polymer is either acrylic acid or methacrylic acid.

51. The element of claim 46 wherein said alkyl acrylic ester moiety of said polymer comprises an alkyl acrylate or methacrylate wherein said alkyl group has from 1 to about 6 carbon atoms.

52. The element of claim 51 wherein said alkyl acrylic ester comprises butyl acrylate.

53. The element of claim 46 wherein said polymer comprises poly[N-(isobutoxymethyl)acrylamide-co-acrylic acid-co-n-butyl acrylate] (10:70:20 weight ratio).

54. The element of claim 47 wherein said vinylidene chloride copolymer comprises poly(acrylonitrile)-co-vinylidene chloride-co-acrylic acid) (12:68:20 weight ratio).

55. The element of claim 46 which comprises a red-sensitive silver halide emulsion layer having a cyan dye image-providing material associated therewith, a green-sensitive silver halide emulsion layer having a magenta dye image-providing material associated therewith, and a blue-sensitive silver halide emulsion layer having a yellow dye image-providing material associated therewith.

* * * * *